US010711953B1

(12) United States Patent
Zhu et al.

(10) Patent No.: US 10,711,953 B1
(45) Date of Patent: Jul. 14, 2020

(54) DUAL POWER FLASHLIGHT

(71) Applicant: SMARTECH INC., Savage, MD (US)

(72) Inventors: Shiqi Zhu, Savage, MD (US); Tao Li, Savage, MD (US)

(73) Assignee: SMARTECH, INC., Savage, MD (US)

( * ) Notice: Subject to any disclaimer, the term of this patent is extended or adjusted under 35 U.S.C. 154(b) by 0 days.

(21) Appl. No.: 16/447,392

(22) Filed: Jun. 20, 2019

(51) Int. Cl.

| | |
|---|---|
| ***F21L 4/04*** | (2006.01) |
| ***F21V 23/00*** | (2015.01) |
| ***F21L 4/02*** | (2006.01) |
| ***F21V 11/18*** | (2006.01) |
| ***F21V 9/08*** | (2018.01) |
| ***F21L 4/08*** | (2006.01) |
| ***F21V 23/06*** | (2006.01) |
| *F21Y 101/00* | (2016.01) |

(52) U.S. Cl.
CPC ..... *F21L 4/045* (2013.01); *F21L 4/027* (2013.01); *F21L 4/08* (2013.01); *F21V 9/083* (2013.01); *F21V 11/186* (2013.01); *F21V 23/009* (2013.01); *F21V 23/06* (2013.01); *F21Y 2101/00* (2013.01)

(58) Field of Classification Search
CPC ... F21L 4/005; F21L 4/045; F21L 4/08; F21V 23/0414; F21V 15/01
USPC ..... 362/196–208
See application file for complete search history.

(56) References Cited

U.S. PATENT DOCUMENTS

| | | | | |
|---|---|---|---|---|
| 5,909,952 | A * | 6/1999 | Guthrie | F21L 2/00 362/184 |
| 2007/0109776 | A1* | 5/2007 | Hilt | F21L 4/06 362/205 |
| 2008/0013307 | A1* | 1/2008 | Kang | F21L 4/085 362/205 |
| 2016/0091153 | A1* | 3/2016 | McLennan | F21V 23/0414 362/183 |
| 2017/0299130 | A1 | 10/2017 | Li et al. | |
| 2018/0231215 | A1* | 8/2018 | Bian | F21V 14/065 |

FOREIGN PATENT DOCUMENTS

| | | |
|---|---|---|
| CN | 2577099 Y | 10/2003 |
| CN | 202132720 U | 2/2012 |

* cited by examiner

*Primary Examiner* — William J Carter
(74) *Attorney, Agent, or Firm* — Welsh Flaxman & Gitler LLC

(57) ABSTRACT

A flashlight includes a light assembly at a first end of the flashlight. The light assembly includes an LED light generating module. The flashlight also includes a power assembly having a power management module body member which houses a charging input port, a USB output port, a LED power indicator, or a power indicator button. A selectively movable sleeve covers the charging input port, the USB output port, the LED power indicator, or the power indicator button when they are not in use, wherein the sleeve moves relative to the power management module body member in linear and rotational directions. The flashlight also includes a central body member between the light assembly and the power assembly.

18 Claims, 4 Drawing Sheets

DUAL POWER FLASHLIGHT

BACKGROUND OF THE INVENTION

1. Field of the Invention

The present invention relates to multi-functional flashlights.

2. Description of the Related Art

Flashlights have been available for years. They provide handheld convenience in a wide variety of environments. The development of LED technology and microelectronics technology has opened the door for a wide variety of innovations. The present invention takes advantage of these developments by integrating modern technology into flashlights in a convenient and reliable manner.

SUMMARY OF THE INVENTION

It is, therefore, an object of the present invention to provide a flashlight including a light assembly at a first end of the flashlight. The light assembly includes an LED light generating module. The flashlight also includes a power assembly having a power management module body member which houses a charging input port, a USB output port, a LED power indicator, or a power indicator button. A selectively movable sleeve covers the charging input port, the USB output port, the LED power indicator, or the power indicator button when they are not in use, wherein the sleeve moves relative to the power management module body member in linear and rotational directions. The flashlight also includes a central body member between the light assembly and the power assembly.

It is also an object of the present invention to provide a flashlight operated with either a rechargeable lithium ion battery or an alkaline battery. The flashlight includes a light assembly at a first end of the flashlight, wherein the light assembly including an LED light generating module. A power assembly is provided at a second end of the flashlight. The power assembly includes at least one of a charging input port, a USB output port, a LED power indicator, and a power indicator button. The power assembly further includes contacts and circuitry for use in conjunction with either a rechargeable lithium ion battery or an alkaline battery. A central body member is provided between the light assembly and the power assembly.

It is another object of the present invention to provide a flashlight operated with either a rechargeable lithium ion battery or an alkaline battery. The flashlight includes a light assembly at a first end of the flashlight, the light assembly including an LED light generating module. The flashlight also includes a power assembly at a second end of the flashlight, the power assembly including at least one of a charging input port, a USB output port, a LED power indicator, and a power indicator button. The power assembly includes a power management module having an electrical contact assembly with first, second, and third spring biased contacts. The first contact is a negative, the second contact is positive and the third contact is inactive. The flashlight also includes a central body member between the light assembly and the power assembly.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Figure 2:
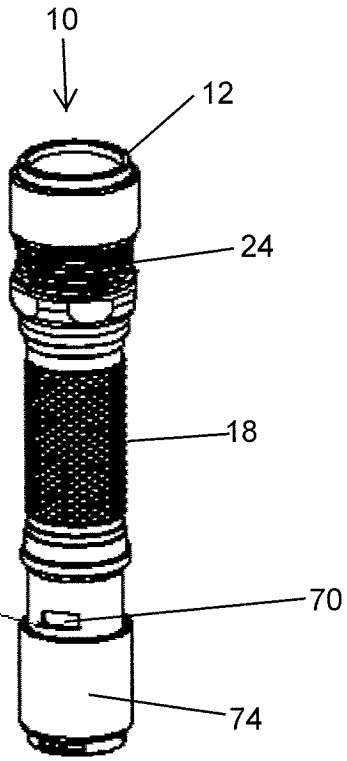
FIG. 2 is front elevation view of the flashlight.
Figure 1:
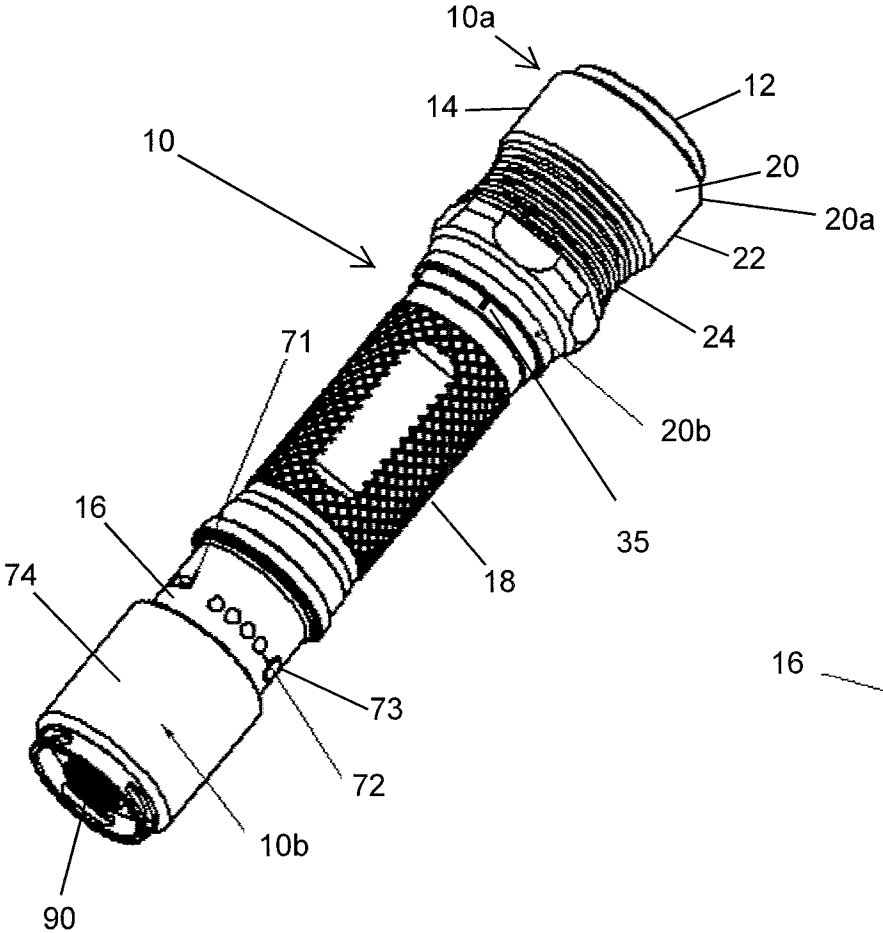
FIG. 1 is a perspective view of the flashlight.
Figure 3:
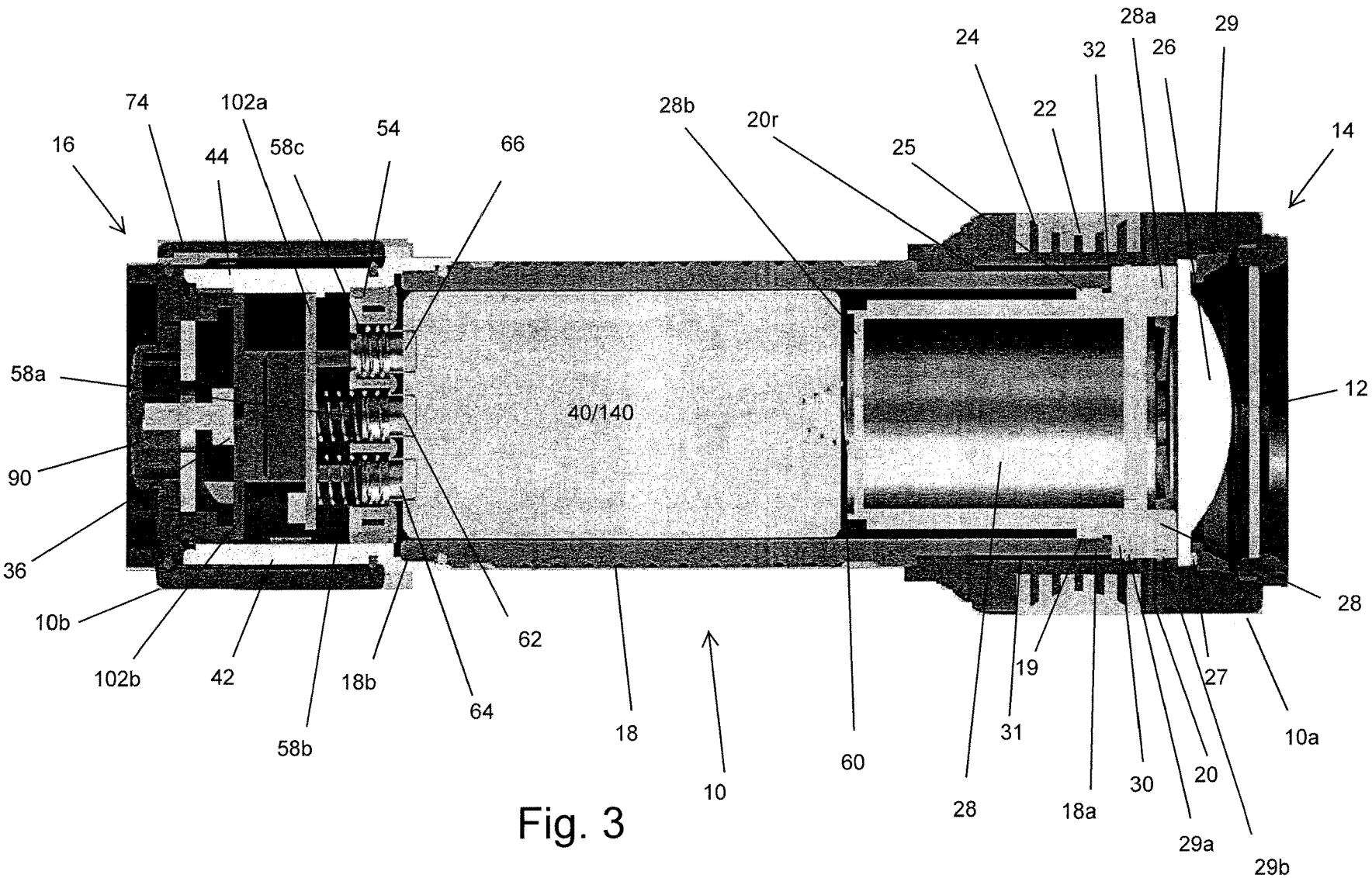
FIG. 3 is a cross sectional view of the flashlight shown in FIGS. 1 and 2.
Figure 4:
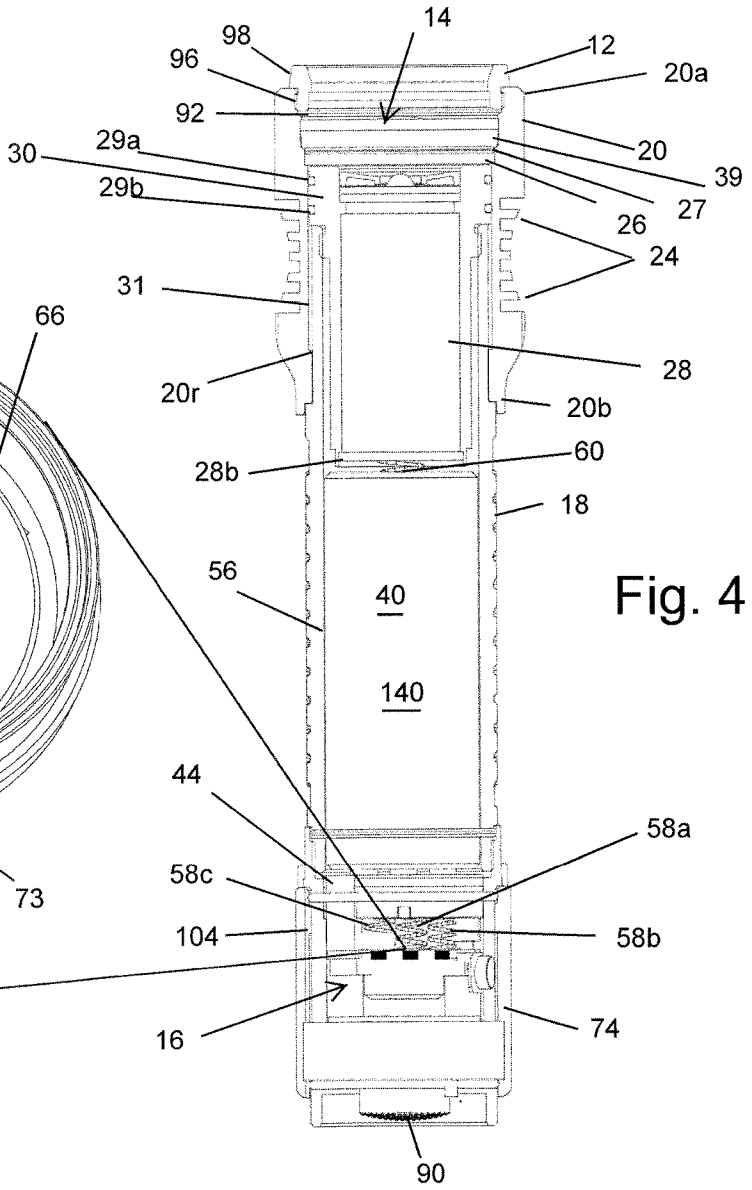
FIG. 4 is another cross sectional view of the flashlight shown in FIGS. 1 and 2.
Figure 5:
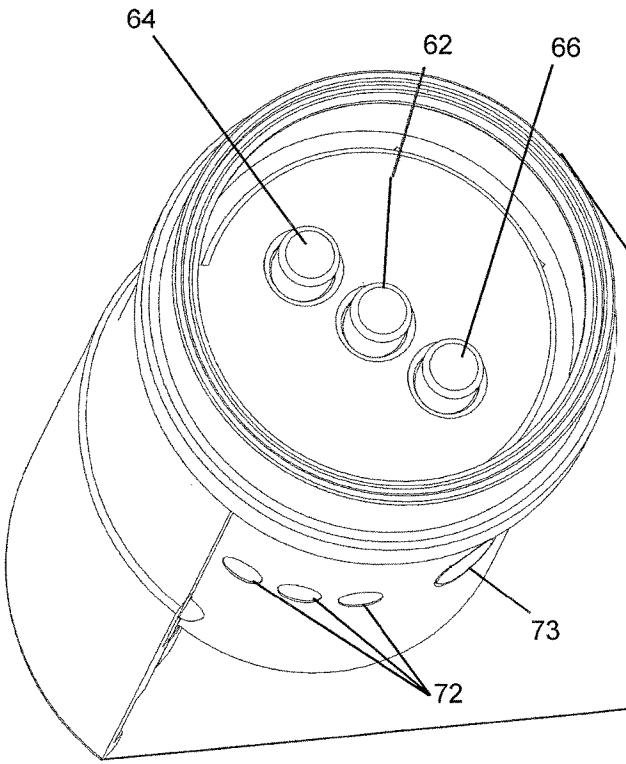
FIG. 5 is a perspective view of the power management module.
Figure 6:
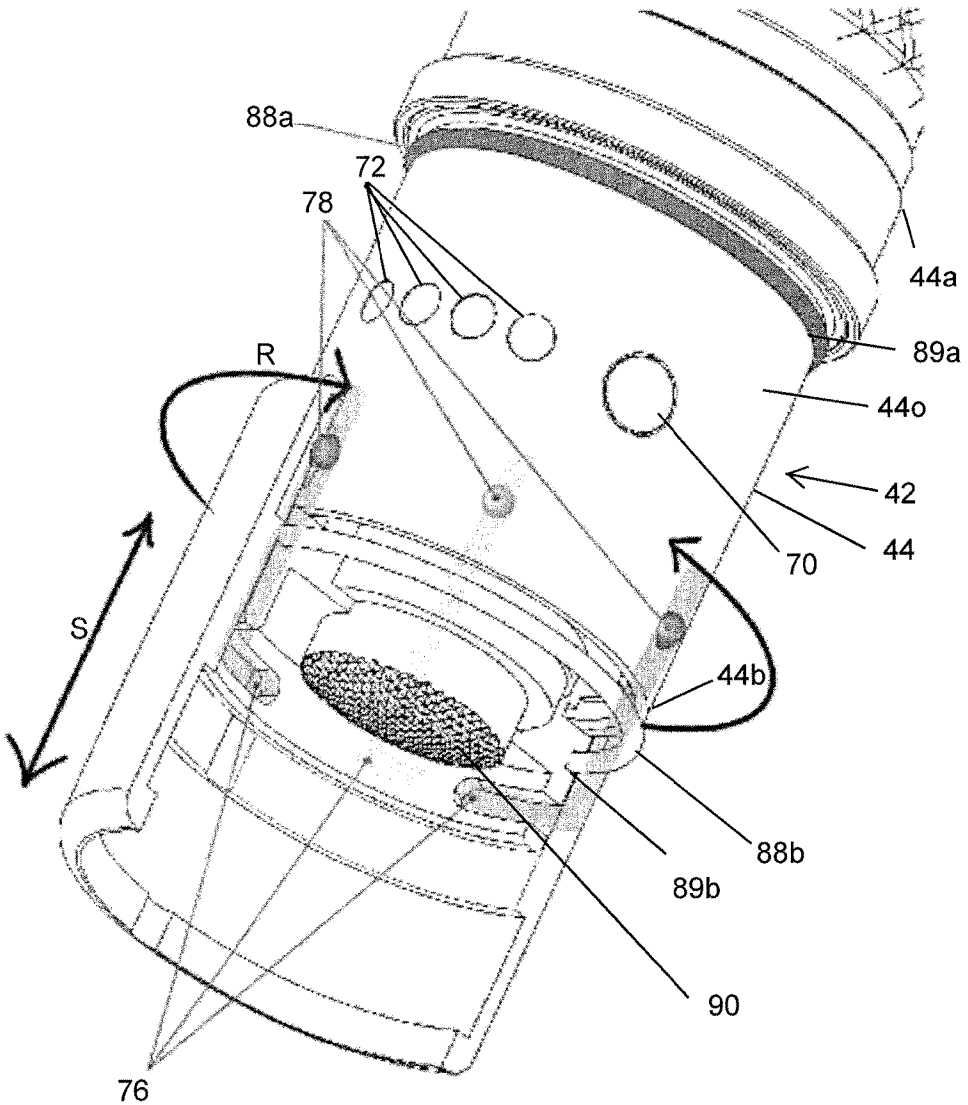
FIG. 6 is a partial sectional view showing operation of the sleeve in conjunction with the power management module.
Figure 7:
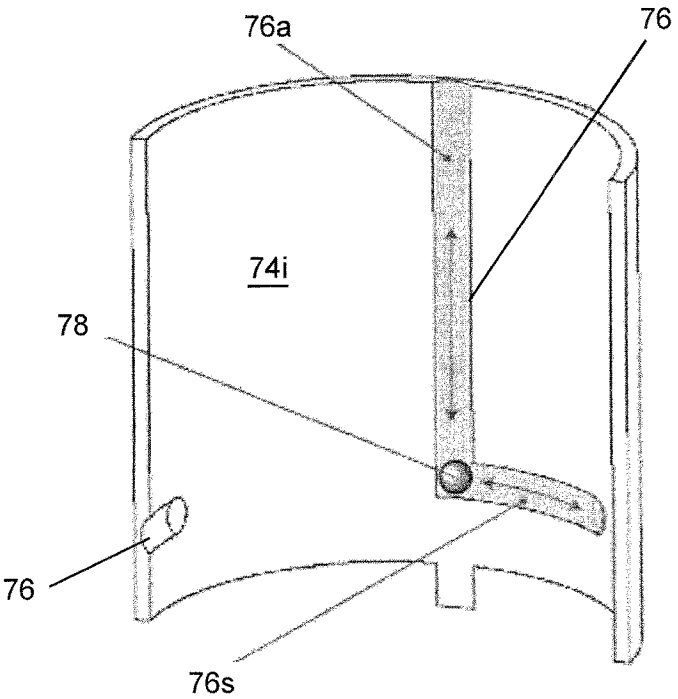
FIG. 7 is a sectional view of the sleeve showing the L-shaped groove.

With reference to FIGS. 1 to 7 a flashlight 10 which is generally powered by a rechargeable lithium ion battery, but can also be powered by traditional alkaline batteries should the lithium ion fail or be low on its charge. The flashlight 10 is also multi-functional.

The flashlight 10 includes a cylindrical construction having a first end 10*a*, a second end 10*b*, and a longitudinal axis extending therebetween. The first end 10*a* includes a light assembly 14, the second end 10*b* includes power assembly 16, and a cylindrical central body member 18 is positioned therebetween. As will be appreciated based upon the following disclosure, the flashlight 10 offers a unique body design that conceals a charging input port 71, a USB output port 70, a series of LED power indicator lights 72 and a power indicator button 73 all under twist and pull metal sleeve 74. As is explained below in greater detail, the sleeve 74 is first twisted about the longitudinal axis of the flashlight to unlock the sleeve 74 and then is pulled linearly along the longitudinal axis of the flashlight to expose the charging input port 71, the USB output port 70, the series of LED power indicator lights 72 and the power indicator button 73.

The first the first end 10*a* of the flashlight 10 is generally composed of the light assembly 14. The light assembly 14 includes a generally cylindrical light assembly body member 20 that is secured to the cylindrical central body member 18 for telescopic movement relative thereto.

The cylindrical light assembly body member 20 includes an outer surface 22 with spaced fins 24 that function to dissipate heat generated through usage of the flashlight 10. The fins 24 also function as a gripping surface. The cylindrical light assembly body member 20 also includes a first end 20*a* and a second end 20*b*. The second end 20*b* of the cylindrical light assembly body member 20 is positioned over the first end 18*a* of the cylindrical central body member 18 in a manner allowing the cylindrical light assembly body member 20 to move relative to the first end 18*a* of the cylindrical central body member 18 such that a lens 26 retained within the cylindrical light assembly body member 20 may be moved relative to a LED light generating module 28 retained within the first end 18*a* of the cylindrical central body member 18 in order to zoom the light in and out as desired by a user and as will be discussed below in greater detail.

Attachment of the light assembly 14 to the cylindrical central body member 18 is achieved in the following manner. Briefly, the body member 20 and the LED light generating module 28 of the light assembly 14 must be substantially assembled before the LED light generating module 28 may be fixedly secured to the cylindrical central body member 18. As the following detailed discussion of the assembly reveals, this allows for efficient and cost-effective assembly of the flashlight in a manner allowing for relative movement between the body member 20 and both the LED light generating module 28 and the central body member 18.

More specifically, the light assembly body member 20 is first attached to the LED light generating module 28 by positioning the LED light generating module 28 within the light assembly body member 20. The lens 26 is then pushed down to its position within the inner circumference of the light assembly body member 20 where it is frictionally held in position adjacent to the first end 28*a* of the LED light generating module 28. Once the lens 26 is in position, a retaining ring 39 with an O-ring 27 is secured in position over the lens 26 and within the inner circumference of the light assembly body member 20. The retaining ring 39 is frictionally secured and may also be adhesively secured to the light assembly body member 20. This functions to secure the light assembly body member 20 and the LED light generating module 28, as the LED light generating module 28 is held between the lens at the first end 20*a* of the light assembly body member 20 and an inwardly directed ridge 20*r* at the second end 20*b* of the light assembly body member 20. The LED light generating module 28 is held between the lens 26 at the first end 20*a* of the light assembly body member 20 and the inwardly directed ridge 20*r* at the second end 20*b* of the light assembly body member 20 in a manner allowing the light assembly body member 20 to move relative to the LED light generating module 28. The transparent lens 26 ultimately sits over the LED light generating module 28 and protects the LED light generating module 28 from the external environment.

The LED light generating module 28 is then secured to the cylindrical central body member 18. In particular, the LED light generating module 28 has external threading 25 which threads into internal central body threads 19 at the first end of the cylindrical body member 18. Adhesive may also be applied to the external threading 25 to form a permanent connection. This functions to secure the first end 18*a* of the cylindrical central body member 18 within the light assembly 14 as defined by the LED light generating module 28 and the light assembly body member 20. The light assembly body member 20 is able to move relative to the cylindrical central body member 18 once the LED light generating module 28 is threadingly coupled to the first end 18*a* of the cylindrical body member 18.

As discussed above, the light assembly body member 20 is able to move relative to the LED light generating module 28. This movement is limited to the space, labeled 31, between the ridge 20*r* on the light assembly body member 20 and an outwardly extending flange 30 on the LED light generating module 28. Two outwardly facing O-rings 29*a*, 29*b* at the outwardly extending flange 30 at the first end 28*a* of the LED light generating module 28 define a bearing surface between the light assembly body member 20 and the LED light generating module 28. This allows the light assembly body member 20 to move up and down smoothly relative to the LED light generating module 28 and provides for a waterproof space between the light assembly body member 20 and the LED light generating module 28.

The relative movement allows the light projected from the flashlight 10 to be zoomed in and out as desired by a user when the cylindrical light assembly body member 20 is moved relative to the cylindrical central body member 18 and the LED light generating module 28 secured within the cylindrical central body member 18. In particular, as the cylindrical light assembly body member 20 is moved, movement of the transparent lens 26 that is fixedly secured to the cylindrical light assembly body member 20 changes the focal length of the light coming from the LED light generating module 28 to zoom the light in and zoom the light out as desired by a user. Control of this zoom functionality is further facilitated by the provisions of zoom markings 35 along the cylindrical central body member 18.

As discussed above, the light assembly 14 also includes the LED light generating module 28 that is positioned within the cylindrical light assembly body member 20 and within the cylindrical central body member 18. In particular, the LED light generating module 28 is placed within the opening defined by the first end 18*a* of the cylindrical central body member 18 and threadingly secured thereto. As the LED light generating module 28 threadingly secured to the first end 18*a* of the cylindrical central body member 18, the outwardly extending flange 30 of the LED light generating module 28 engages the top edge 32 of the cylindrical central body member 18 at the first end 18*a* of the cylindrical central body member 18.

Heat generated by the LED light generating module 28 is dissipated through built-in heat-sink technology formed by spaced fins 24 to quickly release heat from the high lumen output generated by the LED light generating module 28. Further still, the first end 20*a* of the cylindrical light assembly body member 20 is provided with internal threading 92 that allows for selective attachment of colored lenses 12 via external threading 96 provided on the rim 98 of the colored lenses 12. Such colored lenses allow the flashlight to shine red, blue or green. The use of such lenses is of great value to campers, hikers, and hunters. For example, many animals are color blind and, therefore, will not be able to identify the light coming from the flashlight when the colored lenses are used. In addition, various type of animal feces are readily identified under colored light, allowing campers, hikers and/or hunters to identify nearby animals when moving through the woods at night.

The cylindrical central body member 18 defines a cavity into which rechargeable lithium ion battery 40 or traditional alkaline batteries 140 are selectively positioned. In particular, the flashlight 10 includes power assembly 16 at the second end 10*b* of the flashlight 10. The power assembly 16 includes at least one battery 40, 140 that is selectively positioned within the cylindrical central body member 18 for convenient and regular replacement, and a power management module 42 for controlling various elements of the electrical power as will be described below in greater detail.

The power management module 42 includes a power management module body member 44 that is adapted for selective attachment to the second end 18*b* of the cylindrical central body member 18. The power management module body member 44 may be cylindrical in shape. Selective attachment of the cylindrical central body member 18 and the power management module body member 44 is achieved via a threaded relationship wherein threads 46 formed on the inner wall 48 at the first end 44*a* of the power management module body member 44 selectively engage threads 50 formed on the outer wall 52 at the second end 18*b* of the cylindrical central body member 18. When the power management module body member 44 is secured to the cylindrical central body member 18, the cavity at the second end 10*a* of the flashlight 10 is fully closed to retain at least one battery 40, 140 therein.

An electrical contact assembly 54 is mounted within the first end 44*a* of the power management module body member 44 and an elongated contact 56 extends upwardly therefrom along the cylindrical central body member 18 for contact with the LED light generating module 28 so as to complete the electric circuit when alkaline batteries are used in conjunction with the present flashlight. The electrical contact assembly 54 includes first, second, and third contacts 62, 64, 66 that are biased upwardly by spring 58*a-c* so that they engage contacts on batteries 40, 140. A spring biased positive contact 60 is also formed along the second end 28*b* of the LED light generating module 28. The spring biased positive contact 60 is linked to the circuitry of the flashlight 10 via the body of the flashlight 10 in a manner known to those skilled in the art.

The present flashlight 10 is adapted for use in conjunction with either a rechargeable lithium ion battery 40 or traditional alkaline batteries 140. As those skilled in the art will appreciate, traditional alkaline batteries 140 as used in accordance with the present invention include a cylindrical body having centrally located positive and negative contacts at opposite ends of thereof. The rechargeable lithium ion battery 40 used in accordance with the present invention also has a cylindrical body with contacts at opposite ends thereof. However, the rechargeable lithium ion battery 40 includes both positive and negative contacts on each end. The positive and negative contacts oriented such that the positive contact is an annular ring positioned about a centrally positioned circular negative contact. As the following disclosure shows, the orientation and position of the contacts in accordance with the present flashlight facilitates utilization of the present flashlight with either rechargeable lithium ion battery 40 or traditional alkaline batteries 140.

The electrical contact assembly 54 is provided with distinct contacts for both rechargeable lithium ion battery 40 and traditional alkaline batteries 140. In particular, the electrical contact assembly 54 is provided with the central negative first contact 62 for use in conjunction with traditional alkaline batteries 140 or lithium ion battery 40. The electrical contact assembly 54 is also provided with second and third contacts 64, 66 for use in conjunction with rechargeable lithium ion battery 40 for charging and output functionality. The second and third contacts 64, 66 are positioned on opposite sides of the negative first contact 62. The second contact 64 functions as a positive contact when a lithium ion battery 40 is used in charging or outputting via the USB outlet port 70 or the charging input port 71 as discussed below in greater detail. In particular, the second contact 64 is positive and the third contact 66 is inactive, but is used to apply a balancing force to the battery. The balancing force occurs as all of the contacts, 62, 64, and 66 are spring biased and push on the bottom of the lithium ion battery 40, thus the battery 40 is pushed at three points instead of two and the battery 40 is prevented from becoming misaligned within the cylindrical central body member 18. The oppositely positioned second and third contacts 64, 66 are used in accordance with the present invention for better connection and balanced contact between the battery and the electrical contact assembly 54 for use in charging of external devices via the power of the lithium ion battery 40.

The respective springs 58*a*, 58*b* of the central negative first contact 62 and the positive second contact 64 directly electrically connect the lithium ion battery 40 to the upper first circuit board 102*a* (discussed below in greater detail), and therefore extend between the central negative first contact 62/positive second contact 64 and the upper first circuit board 102*a*. The balancing third contact 66 includes a spring 58*c*, which is support upon an underlying support surface 54*s* of the electrical contact assembly 54.

In addition, the present flashlight 10 also takes advantage of the spring biased positive contact 60 formed along the second end 28*b* of the LED light generating module 28 in conjunction with the negative first contact 62 to supply power to the LED light generating module 28 as the top and bottom contacts of the top and bottom contacts of the lithium ion battery 40 respectively make contact with the spring biased positive contact 60 of the LED light generating module 28 and the negative first contact 62. As explained above, this contact is linked to the circuitry of the flashlight 10 via wiring (not shown) extending along the body of the flashlight 10 in a manner known to those skilled in the art.

Where alkaline batteries are used, it is appreciated a battery cartridge holding multiple (for example, four) AAA batteries may be used or individual C batteries may be used. In the situation where an alkaline battery(ies) 140 is used, the spring bias from the various contacts pushes the battery (ies) 140 or a cartridge holding the batteries such that the upper end of the battery(ies) 140 or the cartridge holding the batteries is pushed into engagement with an positive contact 60 formed along the second end 28*b* of the LED light generating module 28 and the lower end of the battery(ies) 140 or the cartridge holding the batteries is in contact with negative first contact 62. In this way, a complete circuit amongst the electrical contact assembly 54 of the power management module body member 44, positive contact 60 of the LED light generating module 28 and the battery(ies) 140 or the cartridge holding the batteries positioned therebetween is ensured. Whether an alkaline battery(ies) 140 or a lithium battery 40 is used in conjunction with the present flashlight 10, the positive and negative contacts of the batteries 40, 140 are place into contact with the negative first contact 62 of the electrical contact assembly 54 and the positive contact 60 at the second end 28*b* of the LED light generating module 28. The flow of electricity, and ultimately the illumination of the LED light generating module 28, is controlled by actuator 36 under the control of the on/off button 90 which is formed as part of the power management module 42 and located at the bottom of the flashlight 10, the operation of which is discussed below in detail. The circuitry controlling operation of the LED light generating module 28 is contained within a lower second printed circuit board 102*b* stored within the power management module 28 and electrical integrated with the operating components in a conventional manner.

Further functionality of the present flashlight 10 is achieved by the provision of a micro USB charging input port 71 and a USB outlet port 70 in the power management module 42, as well as LED charging indicator lights 72 in the power management module 42. The LED charging indicator lights 72 show charging/power status while battery 40 is charging, or with one easy touch of the power indicator button 73 the LED charging indicator lights 72 illuminate and the operator knows the power level at any time. As to the USB outlet port 70, it is provided with input and output protection technology designed to protect cell phones, other small appliance, and the battery. The circuitry implementing the input and output protection technology is found on the upper first printed circuit board 102*a*. The power supply protection technology includes self-discharge protection. In accordance with this self-discharge protection, when power supply (that is, the USB outlet port 70 and the charging input port 71) is off, the outputs of the circuitry are set to off and the power supply can hold the power up to 1 year without recharging. Without this self-discharge protection, the power supply's standby mode would consume 38 mA current, and the power supply could only hold the power up to 10 days as peripheral circuitry would consumes power even if it is not in working status.

The power supply protection technology also provides the USB outlet port 70 with over current/overheat/short circuit protection, which is also integrated into the upper first printed circuit board 102*a*. When the USB outlet port is over-current or short-circuited, the over current/overheat/short circuit protection circuitry quickly enters the protection mode to prevent overheat. When the over-current or short-circuit is corrected, the over current/overheat/short circuit protection circuitry returns to normal status and the USB outlet port 70 voltage will be output normally.

The power supply protection technology also provides over charge protection associated with the charging input port 71. The circuitry for the power supply protection technology is located on the upper first circuit board 102*a*. In accordance with the present invention, a two-stage over-charge protection function is provided. After plugging the charging adapter (not shown) in the charging input port 71, a charging circuit is formed to apply the voltage on the adapter to the battery 40 for charging. As the charging progresses, the first stage is initiated when any voltage is detected to rise to a predetermined level the charging circuit is disconnected, and charging stops. The second stage is activated when any voltage is detected by alternate circuitry of the over-charge protection resulting in the charging circuit being disconnected and the charging is stopped. As long as the first or second or two levels are engaged, the present over charge protection protects against overcharging.

The power supply protection technology also provides over discharge protection, which is integrated into the lower second printed circuit board 102*a*. After discharge has started, when the voltage at any point drops to a predetermined level, the discharge loop is disconnected, and the discharge is completed.

The USB outlet port 70 is formed in the wall of the power management module body member 44 and is electrical connected to negative first contact 62 and the second and third contacts 64, 66 (first contact 62 is negative, the second contact 64 is positive and the third contacts 66 is inactive (but is used to apply a balancing force to the batter as is discussed above); the oppositely positioned second and third contacts 64, 66 are used in accordance with the present invention for better connection and balanced contact between the battery and the electrical contact assembly 54 for use in charging of external devices via the power of the lithium ion battery 40. Regardless of whether the lithium ion battery is being charged or is used to power other devices, the LED charging indicator lights 72 along the power management module body member 44 provide an indication of battery status (while in charging, one of the LED's will flash to indicate it's charging until it's fully charged). The control of the USB outlet port 70 and the LED charging indicator lights 72 is achieved using known circuitry that is incorporated into the power management module 42.

In addition, an on/off button 90 is provided on the bottom of the power management module body member 44. The on/off button 90 is linked to the circuitry of the power management module 42 to control the flashlight in a known manner.

A selectively moveable sleeve 74 is used to cover the charging input port 71, the USB output port 70, the LED charging indicator lights 72, and the power indicator button 73. The sleeve 74 is positioned over the power management module body member 44 for movement between a first position covering the charging input port 71, the USB output port 70, the LED charging indicator lights 72, and the power indicator button 73 and a second position positioned toward the second end 44*b* of the power management module body member 44 such that the charging input port 71, the USB output port 70, the LED charging indicator lights 72 and the power indicator button 73 are fully exposed.

The sleeve 74 has an inner diameter that is slightly larger than the outer diameter of the power management module body member 44. Movement of the sleeve 74 relative to the power management module body member 44 is achieved by three L-shaped grooves 76 formed along the inner surface 74*i* of the sleeve 74 and three mating projecting track balls 78 formed along the outer surface 44*o* of the power management module body member 44. The grooves 76 slide along track balls 78 as the sleeve 74 is first slides along the length of the short leg 76*s* of the "L" such that the sleeve 74 rotates (see curve arrow R) about the longitudinal axis of the flashlight 10 and then slides (see arrow S) along the length of the long leg 76*a* of the "L" such that the sleeve 74 moves linearly along the longitudinal axis of the flashlight 10 to expose the charging input port 71, the USB output port 70, the series of LED power indicator lights 72 and the power indicator button 73. The movement to conceal is just the opposite. While three grooves and track balls are disclosed in accordance with a preferred embodiment, it is appreciate the number of such members may be varied without departing from the spirit of the present invention. The inner surface of the sleeve 74 is provided with a hard ring 104 that interacts with the power management module body member 44 to stop the sliding movement of the sleeve 74 downwardly when the hard ring 104 touches the bottom of the power management module body member 44. In this way, and considering the sleeve 74 when it is in its first position covering the charging input port 71, the USB outlet port 70, the LED charging indicator lights 72 and the power indicator button 73, the sleeve 74 is first rotated about the longitudinal axis of the flashlight 10 and then the sleeve 74 is moved downwardly along the longitudinal axis of the flashlight 10 to move the sleeve 74 to its second position and reveal the charging input port 71, the USB output port 70, the LED charging indicator lights 72 and the power indicator button 73. When it is desired to cover the charging input port 71, the USB output port 70, the LED charging indicator lights 72 and the power indicator button 73, the process is reversed.

This twist to unlock and push/pull design functions selectively to conceal and expose operational components of the flashlight 10 for quick and easy access. The sleeve 74 also protects the operational components from water via the inclusion of sealing members in the form of upper O-ring 88*a* and lower O-ring 88*b* positioned between the sleeve 74 and the power management module body member 44. The O-rings 88*a*, 88*b* are held within grooves 89*a*, 89*b* formed along the power management module body member 44.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A flashlight, comprising:

a light assembly at a first end of the flashlight, the light assembly including an LED light generating module;

a power assembly including a power management module body member which houses a charging input port, a USB output port, a LED power indicator, or a power indicator button, a selectively movable sleeve covers the charging input port, the USB output port, the LED power indicator, or the power indicator button when they are not in use, wherein the sleeve moves relative to the power management module body member in linear and rotational directions;

a central body member between the light assembly and the power assembly; and wherein movement of the sleeve is controlled via L-shaped grooves formed along an inner surface of the sleeve and mating track balls formed along an outer surface of the power management module body member of the power assembly.

2. The flashlight according to claim 1, further including an O-ring between the sleeve and the power management module body member.

3. The flashlight according to claim 1, wherein the light assembly includes a light assembly body member that is secured to the central body member for telescopic movement relative thereto, and the LED light generating module is coupled to the central body such that light assembly body member is able to move relative to the LED light generating module in a manner allowing a user to zoom the light in or out as desired.

4. The flashlight according to claim 3, wherein zoom markings are provided along the central body member.

5. The flashlight according to claim 1, further including threaded red, green, and/or blue colored lenses.

6. The flashlight according to claim 1, wherein the power management module includes an electrical contact assembly with first, second, and third contacts, wherein the first contact is a central first spring biased contact, the second contact is a second spring biased contact on one side of the first spring biased contact, and the third contact is a third spring biased contact on an opposite side of the first spring biased contact, the second spring biased contact and the third spring biased contact push on the first of the battery applying balanced force to the battery to prevent the battery from becoming misaligned within the central body member.

7. The flashlight according to claim 6, wherein the first contact is a negative, the second contact is positive, and the third contact is inactive.

8. The flashlight according to claim 6, further including a contact formed along a second end of the LED light generating module.

9. A flashlight operated with either a rechargeable lithium ion battery or an alkaline battery, comprising:

a light assembly at a first end of the flashlight, the light assembly including an LED light generating module;

a power assembly at a second end of the flashlight, the power assembly including at least one of a charging input port, a USB output port, a LED power indicator, and a power indicator button, the power assembly further including circuitry for use in conjunction with either a rechargeable lithium ion battery or an alkaline battery, and the power assembly also including an electrical contact assembly with a central first electrical contact, a second electrical contact on one side of the first contact, and a third contact on an opposite side of the central first electrical contact, which all contact a first end of a battery;

a contact formed along a second end of the LED light generating module, opposite the contact assembly, which contacts a second end of the battery opposite the first end of the battery;

wherein when the battery is a rechargeable lithium ion battery, the central first electrical contact is engaged with a negative contact of the rechargeable lithium ion battery and the second electrical contact and third contact are engaged with a positive contact of the rechargeable lithium ion battery, and when the battery is an alkaline battery the central first electrical contact is engaged with a negative contact of the alkaline battery, the second electrical contact and third inactive contact are not in engagement with a contact of the alkaline battery, and the contact formed along the second end of the LED light generating module is engaged a positive contact of the alkaline battery; and a central body member between the light assembly and the power assembly.

10. The flashlight according to claim 9, wherein the light assembly includes a light assembly body member that is secured to the central body member for telescopic movement relative thereto, and the LED light generating module is coupled to the central body such that light assembly body member is able to move relative to the LED light generating module in a manner allowing a user to zoom the light in or out as desired.

11. The flashlight according to claim 10, wherein zoom markings are provided along the central body member.

12. The flashlight according to claim 9, further including threaded red, green, and/or blue colored lenses.

13. The flashlight according to claim 9, wherein the power assembly includes a power management module body member which houses a charging input port, a USB output port, a LED power indicator, or a power indicator button and further includes a selectively twistable and movable sleeve that covers the charging input port, the USB output port, the LED power indicator, or the power indicator button when they are not in use.

14. The flashlight according to claim 13, wherein movement of the sleeve is controlled via L-shaped grooves formed along an inner surface of the sleeve and mating track balls formed along an outer surface of a power management module body member of the power assembly.

15. A flashlight operated with either a rechargeable lithium ion battery or an alkaline battery, comprising:

a light assembly at a first end of the flashlight, the light assembly including an LED light generating module;

a power assembly at a second end of the flashlight, the power assembly including at least one of a charging input port, a USB output port, a LED power indicator, and a power indicator button, wherein the power assembly includes power management module having an electrical contact assembly with first, second, and third contacts which all make contact with a first end of a battery, the first contact is a negative, the second contact is positive and the third contact is inactive; and a central body member between the light assembly and the power assembly, wherein the first contact is a central first spring biased electrical contact, the second contact is a second spring biased electrical contact on one side of the central first spring biased electrical contact, and the third contact is a third spring biased inactive contact on an opposite side of the central first spring biased electrical contact, the second spring biased electrical contact and the third spring biased contact push on the first end of the battery applying balanced force to the battery to prevent the battery from becoming misaligned within the central body member; and wherein when the battery is a rechargeable lithium ion battery, the first contact is engaged with a negative contact of the rechargeable lithium ion battery and the second and third contacts are engaged with a positive contact of the rechargeable lithium ion battery, and when the battery is an alkaline battery, the first contact is engaged with a negative contact of the alkaline battery and the second and third contacts are not in engagement with an alkaline battery contact.

16. The flashlight according to claim 15, wherein the light assembly includes a light assembly body member that is secured to the central body member for telescopic movement relative thereto, and the LED light generating module is coupled to the central body such that light assembly body member is able to move relative to the LED light generating module in a manner allowing a user to zoom the light in or out as desired.

17. The flashlight according to claim 15, wherein the power assembly includes a power management module body member which houses a charging input port, a USB output port, a LED power indicator, or a power indicator button and further includes a selectively twistable and movable sleeve that covers the charging input port, the USB output port, the LED power indicator, or the power indicator button when they are not in use.

18. The flashlight according to claim 17, wherein movement of the sleeve is controlled via L-shaped grooves formed along an inner surface of the sleeve and mating track balls formed along an outer surface of a power management module body member of the power assembly.

* * * * *